US010190598B2

(12) United States Patent
Veitch et al.

(10) Patent No.: US 10,190,598 B2
(45) Date of Patent: Jan. 29, 2019

(54) INTERMITTENT SPIGOT JOINT FOR GAS TURBINE ENGINE CASING CONNECTION

(71) Applicant: PRATT & WHITNEY CANADA CORP., Longueuil (CA)

(72) Inventors: Thomas Veitch, Toronto (CA); Tibor Urac, Mississauga (CA); Tyler Richardson, Etobicoke (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 366 days.

(21) Appl. No.: 15/046,568

(22) Filed: Feb. 18, 2016

(65) Prior Publication Data

US 2017/0241434 A1 Aug. 24, 2017

(51) Int. Cl.

| | |
|---|---|
| ***F01D 25/24*** | (2006.01) |
| ***F04D 29/52*** | (2006.01) |
| ***F04D 29/28*** | (2006.01) |
| ***F04D 29/64*** | (2006.01) |
| *F01D 25/16* | (2006.01) |

(52) U.S. Cl.

CPC ..... *F04D 29/526* (2013.01); *F01D 25/24* (2013.01); *F04D 29/284* (2013.01); *F04D 29/644* (2013.01); *F01D 25/162* (2013.01); *F01D 25/243* (2013.01); *Y10T 403/7062* (2015.01); *Y10T 403/7067* (2015.01); *Y10T 403/7069* (2015.01)

(58) Field of Classification Search

CPC .. F01D 25/243; F01D 25/162; Y10T 403/642; Y10T 403/645; Y10T 403/648; Y10T 403/7062; Y10T 403/7067; Y10T 403/7069; Y10T 403/64

See application file for complete search history.

(56) References Cited

U.S. PATENT DOCUMENTS

| | | | | |
|---|---|---|---|---|
| 2,608,368 A * | 8/1952 | Bagge | G01B 5/255 | 246/180 |
| 4,820,124 A | 4/1989 | Fried | | |
| 5,116,013 A | 5/1992 | Malcolmson | | |
| 5,503,490 A * | 4/1996 | Melton | F01D 25/243 | 403/28 |
| 6,106,188 A * | 8/2000 | Krautzig | F01D 5/3007 | 403/28 |
| 6,126,357 A * | 10/2000 | Alkelin | F01D 5/025 | 403/273 |

(Continued)

FOREIGN PATENT DOCUMENTS

| | | | |
|---|---|---|---|
| GB | 715086 A * | 9/1954 | F01D 5/066 |
| JP | 6220963 | 1/1987 | |

*Primary Examiner* — Jason Shanske
*Assistant Examiner* — Behnoush Haghighian
(74) *Attorney, Agent, or Firm* — Norton Rose Fulbright Canada L.L.P.

(57) ABSTRACT

A gas turbine engine casing apparatus includes annular first and second annular cases connected by a spigot joint. The spigot joint includes an annular projection of the first annular case fitted into an annular recess of the second annular case. A plurality of circumferentially spaced apart scallops are formed on one of surfaces of the annular projection or of the annular recess, and are located in selective circumferential locations adjacent respective enhanced stiff areas of the first and second annular cases.

10 Claims, 5 Drawing Sheets

(56) References Cited

U.S. PATENT DOCUMENTS

| | | | | |
|---|---|---|---|---|
| 7,329,088 | B2 * | 2/2008 | Barrett | F01D 25/162 415/136 |
| 7,370,467 | B2 | 5/2008 | Eleftheriou et al. | |
| 7,797,922 | B2 * | 9/2010 | Eleftheriou | F01D 25/162 415/208.4 |
| 7,912,587 | B2 | 3/2011 | Walters et al. | |
| 8,943,840 | B2 | 2/2015 | Williams | |
| 8,944,749 | B2 * | 2/2015 | Durocher | F01D 9/065 184/6.11 |
| 9,169,728 | B2 * | 10/2015 | Wallace | F01D 21/04 |
| 9,470,151 | B2 * | 10/2016 | Ruberte Sanchez | F02K 3/10 |
| 2016/0003077 | A1 * | 1/2016 | Banks | F01D 11/005 60/806 |
| 2016/0265550 | A1 * | 9/2016 | Annati | F04D 29/444 |
| 2016/0356181 | A1 * | 12/2016 | Karamayruc | F01D 25/243 |

* cited by examiner

INTERMITTENT SPIGOT JOINT FOR GAS TURBINE ENGINE CASING CONNECTION

TECHNICAL FIELD

The application relates generally to gas turbine engines and, more particularly, to spigot joints of gas turbine engine casing apparatuses.

BACKGROUND OF THE ART

In gas turbine engines a casing assembly is provided to house and support a number of rotors such as fan, compressor and turbine rotors. A conventional casing assembly may include a fan case, an intermediate case, a compressor case, a gas generator case, a turbine case and turbine exhaust case arranged about a central axis of the engine. The individual cases may be connected one to another for example by flanges and fasteners. A spigot joint may be provided between two connected cases such as the intermediate and compressor cases in order to provide concentricity control of the two cases. However, different cases may be made of different materials which have different thermal expansion coefficients. This may cause excessive tightening of the spigotted joint which can in turn cause high stress areas near the spigotted joint during engine operation. These high stress areas may be at locally stiff features such as bosses, discrete struts or supports, etc. and therefore may be at risk of component damage such as strut cracking.

Therefore, improved case joints are needed to relieve local loads generated by a tight spigot while maintaining concentricity control of the mating parts.

SUMMARY

In one aspect, there is provided a gas turbine engine casing apparatus comprising a first annular case and a second annular case axially connected by a spigot joint, the spigot joint including a projection having a first annular mating surface axially projecting from an end of the first annular case and a recess having a second annular mating surface axially extending into an end of the second annular case, the projection being received in the recess such that the first and second annular mating surfaces mate each other, and a plurality of circumferentially extending intermittent scallops circumferentially spaced from one another and formed on at least one of the first and second annular mating surfaces, the scallops being located at selected circumferential locations to reduce a local contact area between the mating surfaces of the projection and the recess.

In another aspect, there is provided a gas turbine engine casing apparatus having a first case including at least a first annular wall integrated with and supported by a plurality of circumferentially spaced apart and radially extending struts and a second case including at least a second annular wall, the first and second annular walls being axially connected by a spigot joint, the spigot joint comprising: an annular projection having outer-diameter and inner-diameter surfaces co-axially projecting from an end of the first annular wall and an annular recess having outer-diameter and inner-diameter surfaces axially extending into an end of the second annular wall, the annular projection being received in the annular recess such that the two outer-diameter surfaces mate with each other or the two inner-diameter surfaces mate with each other, and a plurality of circumferentially extending and spaced apart grooves formed on one of the surfaces, the grooves being located circumferentially adjacent the respective struts to reduce a local contact area between the projection and the recess.

In a further aspect, there is provided a gas turbine engine comprising an intermediate case axially connected to an annular compressor case by a spigot joint, the intermediate case including a plurality of annular walls connected by a plurality of radially extending struts, the spigot joint including an annular projection having first outer-diameter and first inner-diameter surfaces extending axially from an end of one of the annular walls and an annular recess formed radially between second outer-diameter and second inner-diameter surfaces extending axially into an end of the annular compressor case, the annular projection being received in the annular recess such that the first and second outer-diameter surfaces mate with each other or the first and second inner-diameter surfaces mate with each other, and a plurality of circumferentially extending and spaced apart grooves formed on one of the first and second outer-diameter surfaces, the grooves being located circumferentially adjacent the respective struts to reduce a local contact area between the projection and the recess.

DESCRIPTION OF THE DRAWINGS

Reference is now made to the accompanying figures in which.

It will be noted that throughout the appended drawings, like features are identified by like reference numerals.

DETAILED DESCRIPTION

Figure 1:
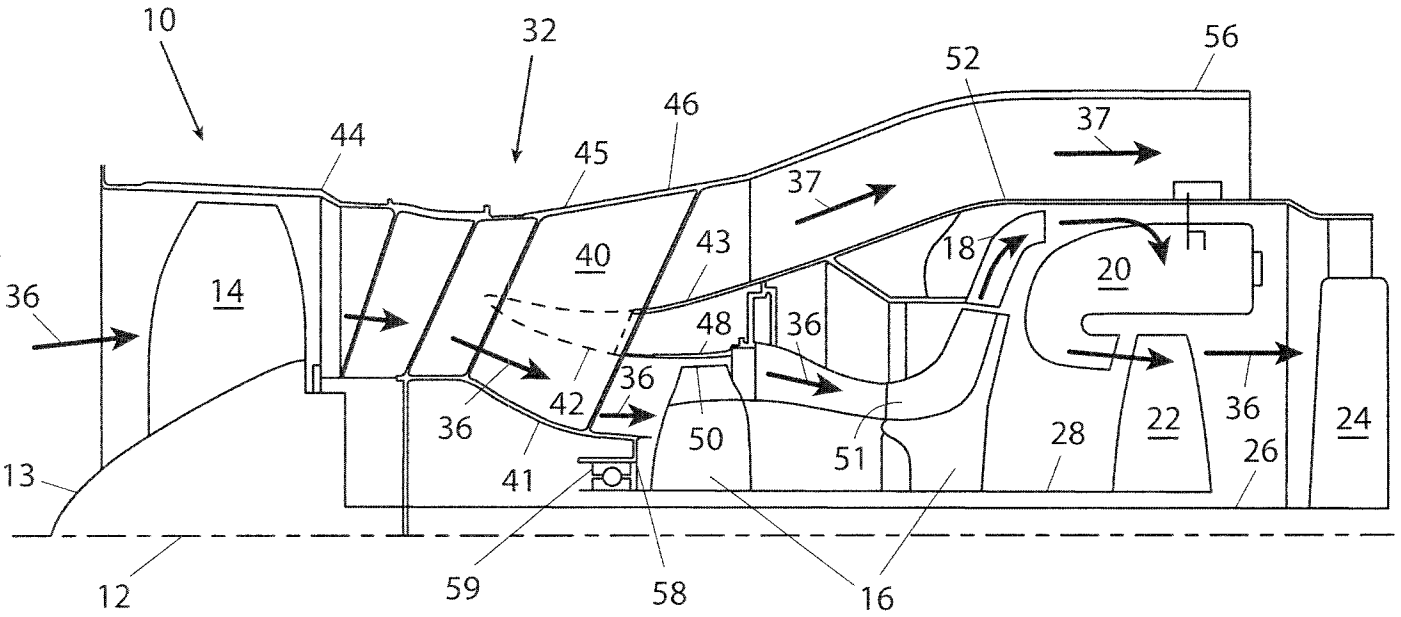
FIG. 1 is a partial schematic side cross-sectional view of a gas turbine engine as an example illustrating application of the described subject matter.

FIG. 1 illustrates an examplary turbofan gas turbine engine 10 which includes in serial flow communication about a longitudinal central axis 12, a fan assembly 13 having a plurality of circumferentially spaced fan blades 14, a high pressure compressor (HPC) assembly 16 having a plurality of circumferentially spaced compressor blades 50 and blades 51, a diffuser 18, a combustor 20, a high pressure turbine (HPT) 22 and a low pressure turbine (LPT) 24. LPT 24 is connected to the fan assembly 13 by a low pressure (LP) shaft 26, and HPT 22 is connected to the HPC assembly 16 by a high pressure (HP) shaft 28.

It should be noted that the terms "axial", "radial" and "circumferential" used for various components throughout the description and appended claims are defined with respect to the longitudinal central axis 12 of the engine.

A generally cylindrical casing assembly 32 envelops the engine 10 and thereby defines a main flow path (indicated by arrows) 36 through a core of engine 10 and a bypass flow path (indicated by arrows) 37.

Is should be noted that the terms "upstream", "downstream", "front" and "aft" are defined with respect to the direction of the air flow entering into and passing through the main flow path 36 of the engine 10.

The casing assembly 32 according to one embodiment may include a generally cylindrical fan case 44, which houses the fan rotor assembly 13, a generally cylindrical intermediate case 46 downstream of the fan case 44 and a gas generator case 52 downstream of the intermediate case 46. The intermediate case 46 may include a bearing seat 58 for mounting an HP bearing 59 thereto. The cylindrical casing assembly 32 may further include a cylindrical bypass duct case 56 generally surrounding the gas generator case 52 and a cylindrical compressor shroud 48 which encircles blade tips of the HPC assembly 16. The cylindrical compressor shroud 48, gas generator case 52 and the bypass duct case 56 are located downstream of and are connected to the intermediate case 46.

Figure 2:
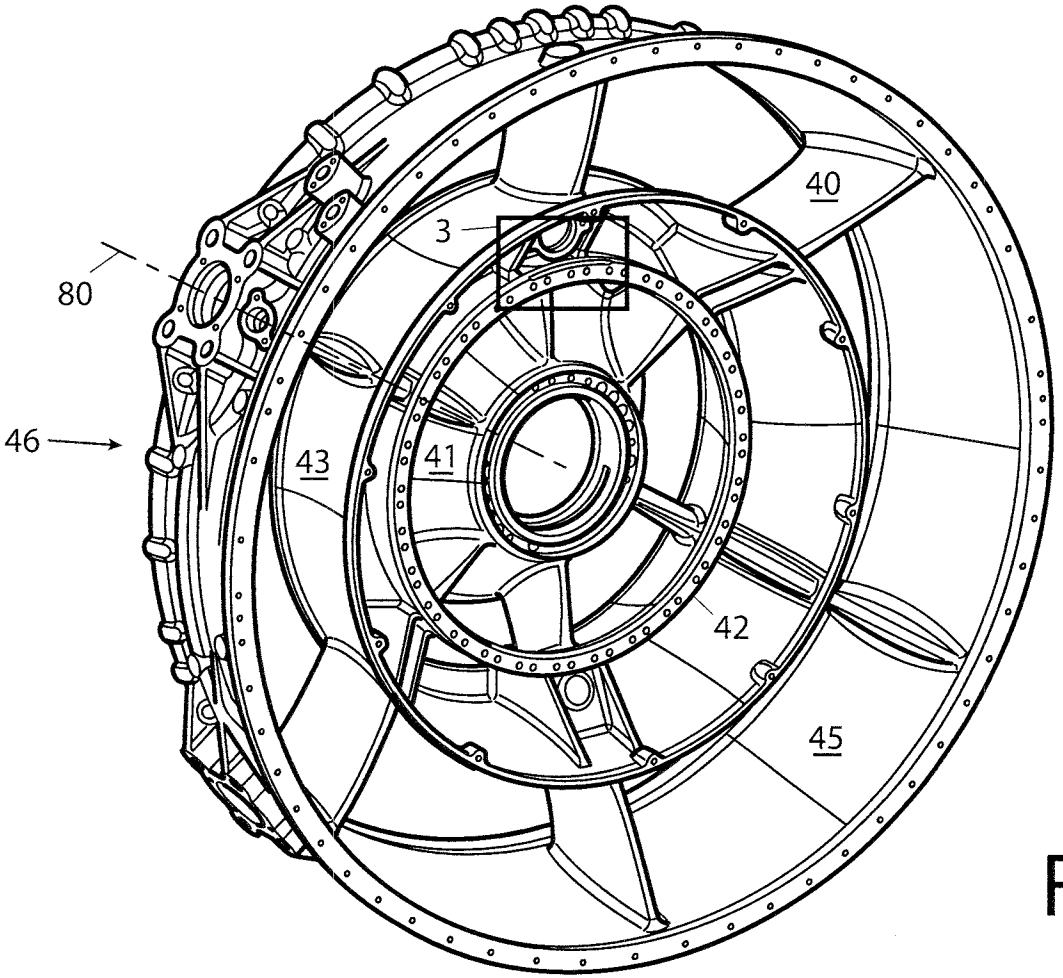
FIG. 2 is an isometric view of an intermediate case which may be used in the gas turbine engine of FIG. 1.
Figure 3:
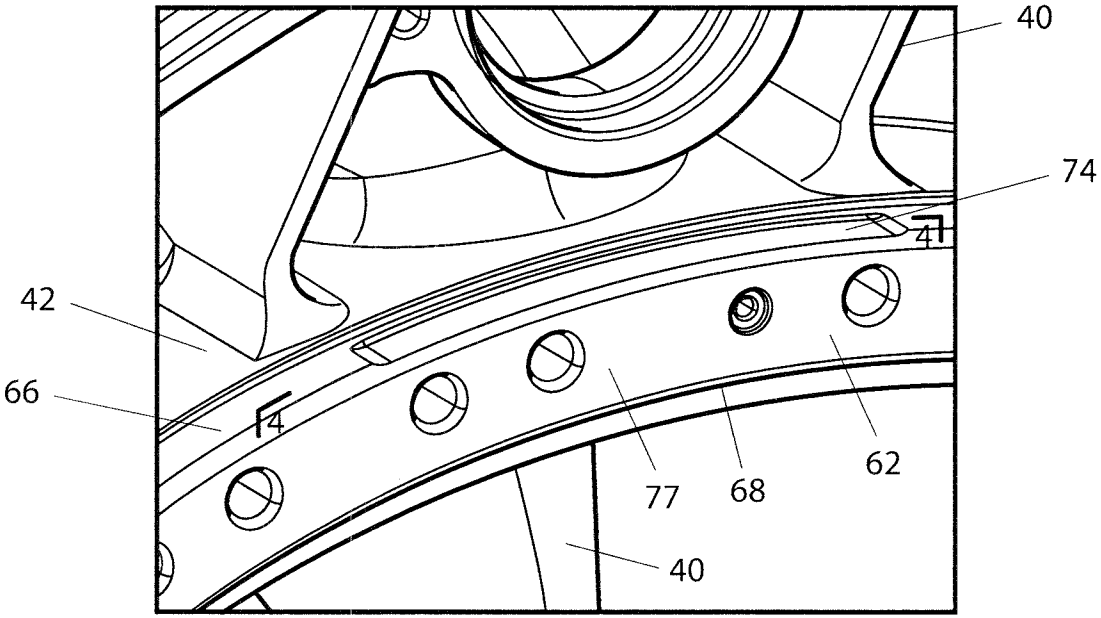
FIG. 3 is a partial isometric view of the intermediate case of FIG. 2, showing the block area 3 thereof in an enlarged scale.
Figure 4:
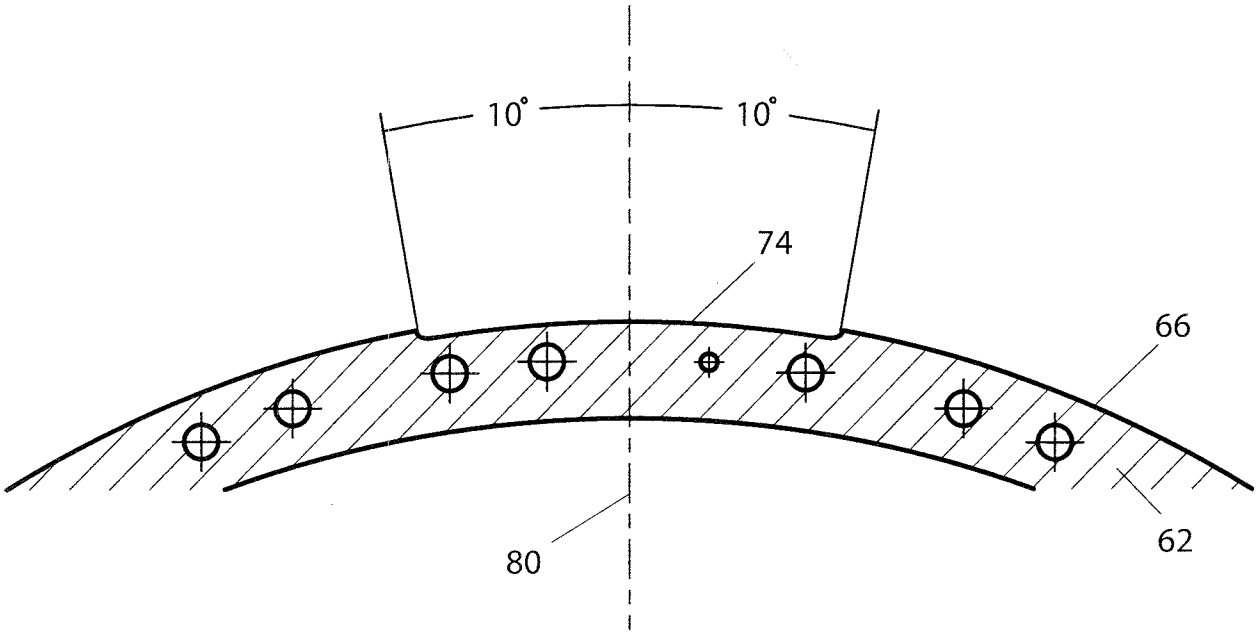
FIG. 4 is a partial cross-sectional view of the intermediate case taken along line 4-4 in FIG. 3, showing the circumferential dimension and location of a shallow groove in a spigot with respect to a radial central axis of a strut of the intermediate case.

Referring to FIGS. 1 and 2, the intermediate case 46 according to one embodiment may include a number of cylindrical walls 41, 42, 43 and 45 which are co-axially positioned and radially spaced apart one from another. In a radially outward sequence the cylindrical wall 41 may be an inner hub of the intermediate case 46 to support the bearing seat 58, cylindrical walls 42 and 43 in combination may form at least part of an annular split configuration for dividing the bypass flow path 37 from the main flow path 36, and the cylindrical wall 45 may be an outer wall of the intermediate case 46 and may be connected to the bypass duct 56. The cylindrical walls 42 and 43 of the intermediate case 46 may be connected to the respective compressor shroud 48 and the gas generator case 52.

The intermediate case 46 may further have a plurality of radially extending struts 40 which may each be configured as a hollow structure. The radially extending struts 40 may be circumferentially spaced apart one from another, each connecting or being integrated with the respective cylindrical walls 41, 42, 43, and 45 and thus in combination support all the cylindrical walls 41, 42, 43 and 45 in an integrated configuration to form the intermediate case 46.

Figure 5:
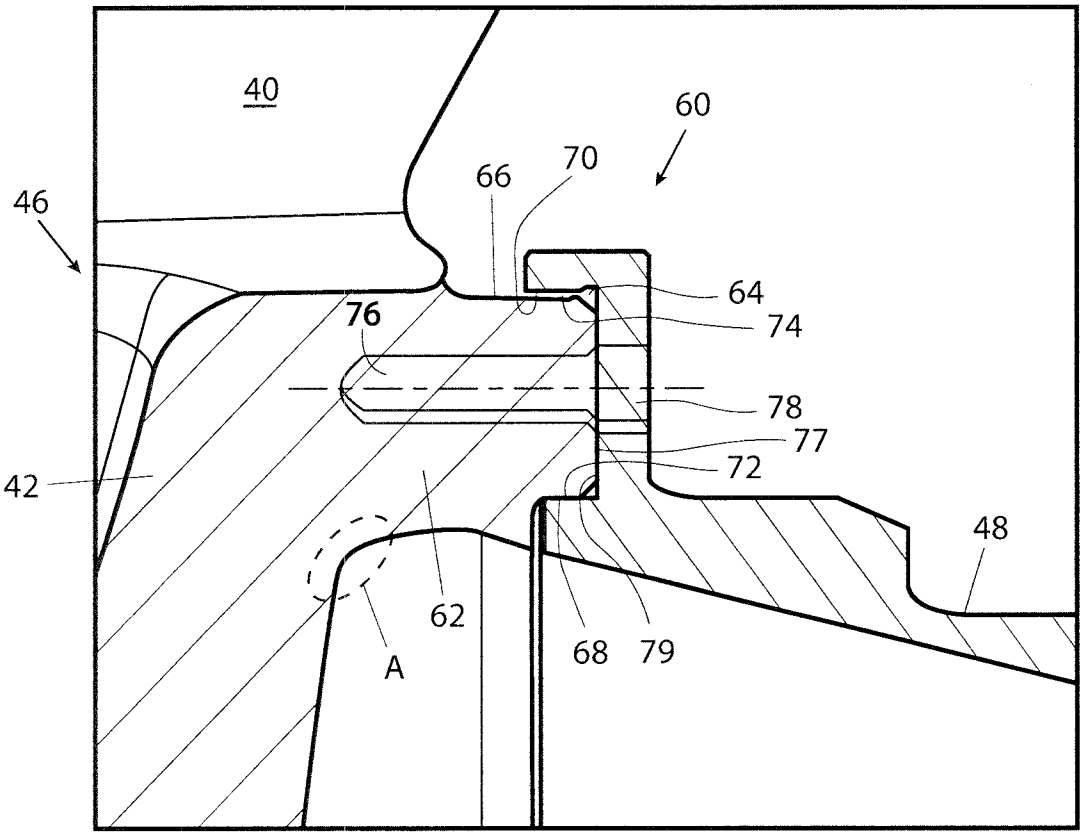
FIG. 5 is a partial cross-sectional view of the intermediate case of FIG. 2 connected by a spigot joint to a compressor case.

Referring to FIGS. 1-5, the cylindrical compressor shroud 48 may be connected to the cylindrical wall 42 of the intermediate case 46 for example by a spigot joint 60 (see FIG. 5). The spigot joint 60 according to one embodiment may include an annular projection 62 integrated with an aft end of the cylindrical wall 42 and may be tightly fitted in an annular recess 64 formed in a front end of the cylindrical compressor shroud 48. The annular projection 62 may have an outer-diameter surface 66 and an inner-diameter surface 68 facing away from each other and axially projecting from the aft end of the cylindrical wall 42. The annular recess 64 may have an outer-diameter surface 70 and an inner-diameter surface 72 which face each other and may axially extend into the front end of the cylindrical compressor shroud 48. It should be noted that outer-diameter surfaces 66 and 70 define a respective annular surface having a diameter greater than a diameter of a respective annular surface defined by inner-diameter surfaces 68, 72. The annular projection 62 may be received in the annular recess 64 such that the outer-diameter surfaces 66 and 70 mate with each other or the inner-diameter surfaces 68 and 72 mate with each other. A plurality of mounting holes 76 and 78 may be provided in the respective annular projection 62 on a radial end surface 77 and a front end (through a radial bottom surface 79 of the annular recess 64) of the cylindrical compressor shroud 48 to receive respective fasteners for securing a spigotted connection between the cylindrical compressor shroud 48 and the cylindrical wall 42 of the intermediate case 46, which forces the annular projection 62 to be fully inserted into the annular recess 64 until the radial end surface 77 of the annular projection 62 is in firm contact with the radial bottom surface 79 of the annular recess 64 in order to secure the spigotted connection between the cylindrical compressor shroud 48 and the intermediate case 46.

A tight fit of the spigot joint 60 is required for concentricity control of the cylindrical wall 42 of the cylindrical intermediate case 46 and the cylindrical compressor shroud 48 for the purpose of blade tip clearance control of the HPC blades 50 with respect to the cylindrical compressor shroud 48. Nevertheless, during engine operation the spigot joint 60 may become excessively tight between the outer-diameter surfaces 66 and 70 due to different thermal expansion coefficients of the two mating parts. For example, the intermediate case 46 according to one embodiment may be made of magnesium and the compressor shroud 48 may be made of titanium which has a thermal expansion coefficient lower than the thermal expansion coefficient of magnesium. At a cold assembly condition according to this embodiment, the spigot joint 60 may be tight between the inner-diameter surfaces 68 and 72. However, under operating conditions such a thermal mismatch of the two mating parts of the spigot joint 60 may result in high compressive stresses developing in a plurality locally stiffer regions indicated by "A", adjacent the respective struts 40. Such local high compressive stresses may cause an elevated risk of stress cracking.

According to one embodiment, a plurality of circumferentially spaced intermittent scallops or shallow grooves 74 (see FIG. 3) may be machined or otherwise provided on, in this example, the outer diameter surface 66 of the annular projection 62 in locations circumferentially adjacent the respective struts 40 in order to reduce a local contact area between the annular projection 62 and the annular recess 64 in order to reduce the occurrence of an over-tight spigot fit during engine operation, potentially relieving some of the compressive stresses developed in the respective regions A.

Alternatively, the scallops or shallow grooves 74 may be provided on the outer-diameter surface 70 of the annular recess 64. Alternatively, scallop the scallops or shallow grooves 74 may be provided on both surfaces 66 and 70.

Optionally, the scallops or shallow grooves 74 may be circumferentially located symmetrically about a radial central axis 80 of the respective radially extending struts 40. Optionally, the scallops or shallow grooves 74 may be configured in an arc profile equal to or less than 20 degrees because the scallops or shallow grooves 74 are provided for locally reducing the presences of an over-tight spigot fit conditions in selected circumferential locations while maintaining concentricity control of the spigotted connection. As noted, the scallops or shallow grooves 74 are circumferentially intermittent, as the skilled reader will appreciate in light of this disclosure that a fully-annular groove may disadvantageously affect spigot fit, such as required for concentricity control of the spigotted connection. The scallops or shallow grooves 74 according to one embodiment may have a depth of 0.015 inches (0.37 mm) or less.

The above-described subject matter may be applicable to spigotted connections between first and second annular engine cases of other types, not limited to the spigotted connection between an intermediate case and a compressor shroud. Furthermore, the plurality of circumferentially extending and spaced apart scallops or shallow grooves 74 may be formed on one of the outer-diameter surfaces 66, 70 or on one of the inner-diameter surfaces 68, 72, and may be located in selective circumferential locations adjacent respective enhanced stiff areas of two connected annular cases. Depending on the particular configuration of the cases, the enhanced stiff areas may be formed with bosses, discrete struts or supports, etc. wherein the local areas may be stiffer than surrounding areas.

As a general example, the plurality of scallops or shallow grooves may be formed on the outer-diameter surface of the annular projection and/or of the annular recess when one of the connected cases which is integrated with the annular projection has a thermal expansion coefficient higher than a thermal expansion coefficient of the other of the connected case which defines the annular recess therein.

As another general example, the plurality of scallops or shallow grooves may be formed on the inner-diameter face of the annular projection or of the annular recess when one of the annular cases which is integrated with the annular projection has a thermal expansion coefficient lower than a thermal expansion coefficient of the other of the connected cases which defines the annular recess.

As a note, spigot connections also exist where there is not a second mating diameter (i.e. 68 and 72 do not exist) where the described subject matter could still apply.

The above description is meant to be exemplary only, and one skilled in the art will recognize that changes may be made to the embodiments described without departing from the scope of the described subject matter. For example, in the above-described embodiments, it is a high pressure compressor (HPC) tip clearance control that is being preserved but the described subject matter is also applicable for low pressure compressor (LPC) tip clearance control. Modifications which fall within the scope of the described subject matter will be apparent to those skilled in the art, in light of a review of this disclosure, and such modifications are intended to fall within the appended claims.

The invention claimed is:

1. A gas turbine engine casing apparatus having a first case including at least a first annular wall integrated with and supported by a plurality of circumferentially spaced apart and radially extending struts and a second case including at least a second annular wall, the first and second annular walls being axially connected by a spigot joint, the spigot joint comprising: an annular projection having outer-diameter and inner-diameter surfaces co-axially projecting from an end of the at least a first annular wall and an annular recess having outer-diameter and inner-diameter surfaces axially extending into an end of the at least a second annular wall, the annular projection being received in the annular recess such that the two outer-diameter surfaces mate with each other or the two inner-diameter surfaces mate with each other, and a plurality of circumferentially extending and spaced apart grooves formed on one of the surfaces, the plurality of grooves being located circumferentially adjacent the respective struts to reduce a local contact area between the projection and the recess, wherein at least one of the plurality of grooves is circumferentially symmetrical about a radial central axis of one of the plurality of struts.

2. The gas turbine engine casing apparatus as defined in claim 1 wherein the plurality of grooves are formed on one of the outer-diameter surfaces.

3. The gas turbine engine casing apparatus as defined in claim 1 wherein the plurality of grooves are formed on one of the two inner-diameter surfaces.

4. The gas turbine engine casing apparatus as defined in claim 1 wherein the plurality of grooves are formed on the outer-diameter surface of the annular projection.

5. The gas turbine engine casing apparatus as defined in claim 2 wherein the first case has a first thermal expansion coefficient higher than a second thermal expansion coefficient of the second case.

6. The gas turbine engine casing apparatus as defined in claim 1 wherein each of the plurality of grooves is configured in an arc profile equal to or less than 20degrees.

7. A gas turbine engine comprising an intermediate case axially connected to an annular compressor case by a spigot joint, the intermediate case including a plurality of annular walls connected by a plurality of radially extending struts, the spigot joint including an annular projection having first outer-diameter and first inner-diameter surfaces extending axially from an end of one of the plurality of annular walls and an annular recess formed radially between second outer-diameter and second inner-diameter surfaces extending axially into an end of the annular compressor case, the annular projection being received in the annular recess such that the first and second outer-diameter surfaces mate with each other or the first and second inner-diameter surfaces mate with each other, and a plurality of circumferentially extending and spaced apart grooves formed on one of the first and second outer-diameter surfaces, the plurality of grooves being located circumferentially adjacent the respective struts to reduce a local contact area between the projection and the recess, wherein at least one of the plurality of grooves is circumferentially symmetrical about a radial central axis of one of the plurality of struts.

8. The gas turbine engine as defined in claim 7 wherein the intermediate case has a first thermal expansion coefficient higher than a second thermal expansion coefficient of the annular compressor case.

9. The gas turbine engine as defined in claim 7 wherein the plurality of grooves are formed on the first outer-diameter surface of the annular projection.

10. The gas turbine engine as defined in claim 7 wherein each of the plurality of grooves is configured in an arc profile equal to or less than 20 degrees.

* * * * *